United States Patent [19]

Kosten et al.

[11] 4,209,218

[45] Jun. 24, 1980

[54] INSULATED ELECTRICAL CONDUCTOR LOCKING ARRANGEMENT AND METHOD

[75] Inventors: Richard B. Kosten; Helmut G. Folgmann, both of Huntsville, Ala.

[73] Assignee: GTE Automatic Electric Laboratories Incorporated, Northlake, Ill.

[21] Appl. No.: 937,357

[22] Filed: Aug. 28, 1978

[51] Int. Cl.[2] ..... H01R 13/38; H01R 13/58

[52] U.S. Cl. ..... 339/97 R; 339/102 R

[58] Field of Search ..... 339/97 C, 97 R, 97 P, 339/102, 98, 99 R

[56] References Cited

U.S. PATENT DOCUMENTS

| | | | |
|---|---|---|---|
| 3,145,261 | 8/1964 | Forney, Jr. | 339/98 |
| 4,097,106 | 6/1978 | Over et al. | 339/102 R |
| 4,159,156 | 6/1979 | Nijman | 339/97 C |

*Primary Examiner*—Joseph H. McGlynn

*Attorney, Agent, or Firm*—Robert J. Black

[57] ABSTRACT

An arrangement and method for locking an insulated electrical conductor to a slot-type terminal wherein a locking device is molded as part of the terminal base. As an insulated electrical conductor to be terminated is pushed into the slot-type terminal with a die type tool cutting edges of the die engage portion of the locking device, cutting it and cold forming the material about the conductor, thereby locking the conductor to the terminal base.

4 Claims, 2 Drawing Figures

INSULATED ELECTRICAL CONDUCTOR LOCKING ARRANGEMENT AND METHOD

BACKGROUND OF THE INVENTION

1. Field of the Invention

This invention relates in general to electrical terminal blocks and more particularly to an arrangement and method for locking an insulated electrical conductor to a terminal block employing slot-type terminal contacts.

2. Description of the Prior Art

Terminal blocks employing electrical terminal contacts, are used in great variety and numbers in communication and other data handling systems to facilitate electrical connection of individual solid or stranded insulated electrical conductors or wire to external circuits or other conductors. In the past, the electrical connection has been accomplished by stripping the insulation from the end of the conductor and then soldering the conductor to the terminal contacts. This procedure requires considerable skill on the part of workmen making the solder connection. In miniaturized terminals particularly, there is also a tendency for the solder to bridge adjacent contacts producing undesired circuit connections. These disadvantages, have been overcome to some extent by terminal blocks that employ insulation-penetrating clip-type, or slot-type terminal contacts.

A typical slot-type contact is shown in U.S. Pat. No. 3,239,796 to S. N. Buchanan, et al, issued Mar. 8, 1966. The terminal contact includes a pair of electrically conductive vertical blades joined at one end and free at the other. The free ends are spaced apart a distance less than the diameter of the conductor. Moreover, the construction of the blades permit penetration of the insulative material to tightly bite into the conductive portion of the electrical conductor. The penetration of the insulation is obtained by compressive forces applied to the conductor during seating of the wire in the terminal contact slot by the contact blades and a precision tool. Problems may arise with this slot-type terminal in that, with the use of smaller diameter wire (24 WGS or greater) the clamping action of the slot and blades to the conductor material is delicate and the wire must be restrained from flexing at this point so as not to damage the conductor. The flexing may cause degradation of the conductor material which ultimately results in the conductor breaking off at the terminal contact.

Accordingly, it is an object of the present invention to provide a simple, effective, arrangement and method for locking an insulated electrical conductor to a terminal block employing slot-type terminal contacts.

Additionally, it is a further object of the invention to provide a locking arrangement that may be formed from the terminal base material without additional loose parts.

SUMMARY OF THE INVENTION

In accomplishing the object of the present invention, there is provided as the environment, a terminal block with at least one terminal contact mounted on a horizontal terminal base composed of a resilient dielectric material such as plastic or the like. The terminal contact has a pair of upstanding blades composed of suitable conductor material, including a mouth at one end for the receipt of an insulated electrical conductor. A passage leading from the mouth includes converging edges for stripping the insulation from the conductor and a slot for engaging the conductor and making an electrical connection thereat.

The locking arrangement in accordance with the present invention, includes a pair of upstanding locking blocks molded as part of the terminal base and arranged parallel and opposite one another defining a channel between them. The channel is disposed in linear alignment with the terminal contact slot. A pair of upstanding guide arms are integrally molded to the terminal base and locking blocks each one positioned immediately behind each block and also forming a guide channel between them. The guide channel is arranged to accept a portion of the insulated electrical conductor and provide for a proper linear alignment of the conductor between the locking blocks and the terminal contact.

The method of terminating and locking an insulated electrical conductor of the present invention includes the steps of positioning in linear alignment a first portion of the insulated electrical conductor in the mouth of the terminal contact, a second portion over the locking channel and a third portion within the guide channel. A die-type tool is used to effect the insertion of the insulated electrical conductor into the terminal contact and the locking of the conductor. The die includes a pair of cutting arms cooperable with the locking blocks and a pair of arcuate bending surfaces each positioned adjacent to a cutting arm and terminating in a central position on the die defining a die nose. With the die positioned over the conductor to be terminated and locked, relative movement of the die downward engages the nose to the conductor forcing the conductor into the contact slot and the locking channel. As the die progresses further downward the cutting arms of the die cut into portions of the locking blocks and the die's bending surfaces bend the cut out portions over the electrical conductor, finally locking the conductor to the terminal base when the conductor is fully seated in the terminal contact.

BRIEF DESCRIPTION OF THE DRAWINGS

A better understanding of the invention may be had from the consideration of the following detailed description taken in conjunction with the accompanying drawings in which:

It should be noted that the terminal contact shown on FIG. 1 and FIG. 2 is illustrated in a broken-line disclosure for ease of understanding the locking method. Further, it is intended for illustrative purposes only and forms no part of the invention.

PREFERRED EMBODIMENT OF THE INVENTION

Figure 1:
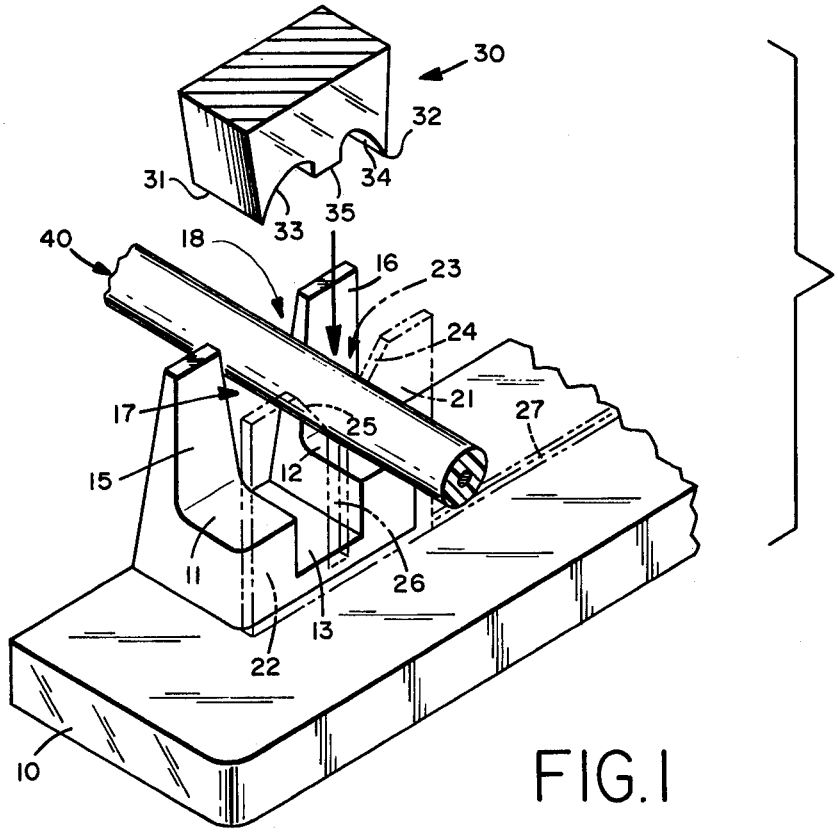
FIG. 1 is a perspective view depicting the terminal contact and locking arrangement with respect to an insulated electrical conductor and insertion die prior to termination and locking in accordance with the present invention described herein.

Referring now to the accompanying drawings of the present invention, FIG. 1 shows a planar horizontal terminal base 10 composed of a suitable dielectric material such as A.B.S. plastic compound or the like. A slot-type terminal contact composed of a suitable conductor material is mounted to terminal base 10 and includes a pair of upstanding blades 21 and 22, symmetrical about a vertical axis which define a mouth 23 for holding an insulated electrical conductor. Converging edges 24 and 25 are adapted to strip the insulation from the conductor. Slot 26 defined by the parallel inside edges of blades 21 and 22, directly engages the conductor as shown on FIG. 2. The terminal contact is electrically connected to either another terminal contact or to an external electrical source by conductor path 27.

Referring back to FIG. 1, the locking arrangement of the present invention includes, a pair of upstanding locking blocks 11 and 12 composed of a resilient dielectric material and are arranged parallel and opposite one another defining a locking channel 13 between them. The channel 13 is in linear alignment with terminal contact slot 26 and is of a width to allow insertion of insulated electrical conductor 40 therein. A pair of upstanding guide arms 15 and 16 are positioned directly behind locking blocks 11 and 12 respectively, and also form a guide channel 17 between them. Inside edges of guide arms 15 and 16 converge inward from a mouth generally shown at 18 to a channel similar in width as channel 13. It should be noted that locking blocks 11 and 12 and guide arms 15 and 16 are composed from the same material as terminal base 10 and are molded with the terminal base as a unitary structure.

A die-type tool 30 is used to effect insertion of the electrical conductor into the terminal contact and locking of the conductor to the terminal base. Die 30, shown on FIG. 1, includes a pair of cutting arms 31 and 32 cooperable with locking blocks 11 and 12, respectively, and a pair of bending surfaces 33 and 34 each positioned adjacent to a respective cutting arm 31 and 32. The bending surfaces are oriented inwardly from each respective cutting arm and terminate at a central portion of the die defining a planar insertion nose 35. It should be noted that the die may also include a handle and means for alignment of the cutting arms to the locking blocks and these may include various methods which are well known in the art. The limitations here being that the die illustrated is composed of a suitable rigid material such as metal or other alloy which can easily cut into the locking blocks.

Figure 2:
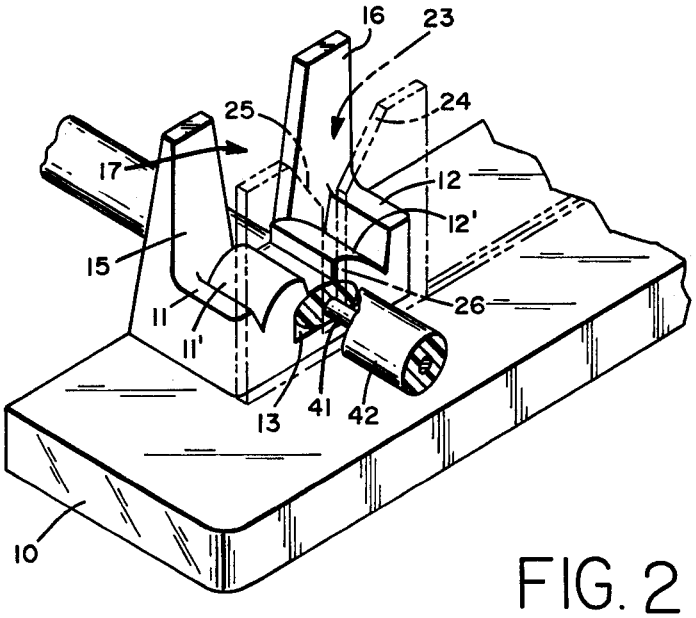
FIG. 2 is a perspective view showing the terminated and locked electrical conductor according to the present invention.

With renewed reference to FIG. 1 and FIG. 2, the preferred method of locking the insulated electrical conductor to the present invention may be more fully understood. Therein, an insulated electrical conductor 40 is shown placed in linear alignment with a first portion within terminal mouth 23, a second portion over channel 13 and a third portion within mouth 18 of guide arms 15 and 16.

A die, 30, is positioned above the conductor and locking blocks 11 and 12 in a general alignment with the blocks.

The termination and locking operation is accomplished by effecting downward movement of the die 30 into contact with the conductor 40 and locking blocks 11 and 12. As the insertion nose 33 longitudinally contacts the conductor 40, the conductor is simultaneously displaced from mouth 23 of the terminal contact and from mouth 18 of the guide arms. As the conductor is forced toward the locking channel 13, converging edges 24 and 25 of the terminal contact penetrate the insulative portion 42 and inside edges of guide arms 15 and 16 help keep the conductor longitudinally aligned to the die insertion nose and guide the conductor into channel 13. Upon complete penetration of the insulative portion 42 of electrical conductor 40 by converging edges 24 and 25 conducting portion 41 is mechanically gripped or coined by terminal contact slot 26 making a conductor-to-terminal contact connection thereat as shown at FIG. 2. A portion of insulation 42 is broken away to illustrate the conductor-to-terminal connection. The termination and arresting is completed as shown in FIG. 2 when die cutting arms 31 and 32 contact locking blocks 11 and 12, respectively, cutting into the blocks forming portions 11' and 12' which are guided over the electrical conductor 40 under control of arcuate die surfaces 33 and 34, thereby locking the conductor to the terminal base. The die may be also fitted with a blade (not shown) which may be projected from the die to cut off excess wire forward of the terminal contact. The die 30 is then removed to be used again at another termination point.

In this fashion an improved connection is formed at the terminal contact. Particularly, arresting any flexing between terminal contact and conductor resulting from vibration or other movements which may affect the quality of the electrical connection.

The present invention has been described with reference to a specific embodiment thereof, for the purpose of illustrating the manner in which the invention may be used to advantage, and it will be appreciated by those skilled in the art that the invention is not limited thereto. Accordingly, any and all modifications, variations or equivalent arrangements which may occur to those skilled in the art should be considered to be within the scope of the invention.

What is claimed is:

1. Locking means for locking an insulated electrical conductor to a terminal apparatus, said terminal apparatus including a base, a slot-type electrical contact terminal including a mouth proximate the top of said slot, said terminal extending upwardly from said base arranged to accept within said slot a first portion of said insulated electrical conductor penetrating said insulation and electrically connecting said conductor to said terminal, said locking means comprising:

at least one locking member of insulating material, said member integrally mounted to said base adjacent to and in alignment with one edge of said slot and a second portion of said insulated electrical conductor;

means adapted to cooperate with said locking member; and in response to the application of a downward force said means excising and guiding a portion of said locking member over said second portion of said insulated electrical conductor to lock said conductor to said terminal base.

2. Locking means as recited in claim 1, wherein: said locking means comprises a pair of locking members of insulating material integrally mounted to said base and defining a channel between said members, said channel in a linear alignment with said slot and adapted to accept within said channel said second portion of said insulated electrical conductor;

means adapted to cooperate with said pair of locking members; and in response to the application of a downward force said means excising and guiding a portion of each of said pair of locking members over said second portion of said insulated electrical conductor to lock said conductor to said terminal base.

3. Locking means as recited in claim 2, wherein: there is included a pair of upwardly extending guide means integrally mounted to said base defining a channel between said guide means and arranged to accept within said channel a third portion of said insulated electrical conductor, said guide means channel in a linear alignment with said locking members channel and disposed to guide and keep said second portion of said conductor in a linear relationship to said first portion of said conductor.

4. Locking means as recited in claim 3, wherein: said base, said locking members and said guide means are composed of an impressible material as a one-piece unitary structure.

* * * * *